United States Patent [19]

Nagatomo et al.

[11] 4,007,663

[45] Feb. 15, 1977

[54] HYDRAULIC PUMP OF THE AXIAL PISTON TYPE

[75] Inventors: Kuniyasu Nagatomo; Masato Hiromatsu, both of Chikushino, Japan

[73] Assignee: Mitsubishi Kogyo Kabushiki Kaisha, Tokyo, Japan

[22] Filed: Jan. 27, 1975

[21] Appl. No.: 544,388

[30] Foreign Application Priority Data

Feb. 1, 1974 Japan ..... 49-13962
Feb. 1, 1974 Japan ..... 49-14056[U]

[52] U.S. Cl. ..... 91/6.5; 91/487; 91/488; 91/499; 91/503; 417/269

[51] Int. Cl.[2] ..... F01B 3/00; F04B 1/12

[58] Field of Search ..... 91/485, 486, 487, 499, 91/503, 482, 6.5, 180, 488; 417/269

[56] References Cited

UNITED STATES PATENTS

| | | | |
|---|---|---|---|
| 3,303,749 | 2/1967 | Ocule | 91/499 |
| 3,411,453 | 11/1969 | Chanal | 417/269 |
| 3,457,873 | 7/1969 | Fischer | 91/6.5 |
| 3,498,227 | 3/1970 | Kita | 91/499 |
| 3,556,683 | 1/1971 | Schott | 417/270 |
| 3,616,726 | 11/1971 | Ruger | 91/488 |
| 3,858,483 | 1/1975 | Hein | 91/486 |

*Primary Examiner*—Carlton R. Croyle
*Assistant Examiner*—G. P. La Pointe
*Attorney, Agent, or Firm*—Toren, McGeady and Stanger

[57] ABSTRACT

A hydraulic pump of the axial piston type comprising check valves each of which is adapted to open and allow the associated cylinder to discharge fluid when the pressure inside the cylinder has been raised above the discharge pressure of the pump by the piston on its compression stroke, passage means for communicating each of the cylinders with the low-pressure system including a pump suction pipe or drain tank during the period in which the piston on the compression stroke moves from a point at least short of the top dead center to a point past the center and where the cylinder communicates with the suction port, and pressure-reducing means disposed in the passage means.

13 Claims, 11 Drawing Figures

HYDRAULIC PUMP OF THE AXIAL PISTON TYPE

This invention relates to an axial piston type hydraulic pump, and more specifically to improvements in a hydraulic pump wherein a plurality of pistons arranged in liquid tight slidable engagement within cylinders are driven for endwise reciprocation by a swash plate.

With a hydraulic pump of this type noisy operation can occur when the differences between the pressures in and out of the cylinders at the time of suction and discharge of fluid are sufficiently high so as to cause excessive pressure changes inside the cylinders. In order to abate the noise, proposals have been made including one in which trapped compression is effected by stopping the fluid discharge from each cylinder during the precompression period, in which the piston is at the beginning of the compression stroke, and also trapped expansion is induced by interrupting the fluid suction to the cylinder during the preexpansion period, or the early period of the suction stroke. The arrangement has drawbacks, however, since when the discharge pressure of the pump falls below the rated level, the fluid pressure in each cylinder will drop to atmospheric during the pre-expansion period and from then until the end of preexpansion the fluid in the cylinder will overexpand, leading to cavitation and therefore bubbling and other unfavorable phenomena. Moreover, if the discharge pressure of the pump exceeds the rated value, the fluid pressure in each cylinder at the end of the preexpansion period will drop so sharply that the noise cannot be reduced.

It is an object of the present invention to provide an axial piston type hydraulic pump capable of less noisy operation than conventional pumps of the type.

Another object of the invention is to provide a pump wherein the fluid pressure in the cylinders is gradually and moderately increased and decreased to minimize the noise during operation.

Still another object of the invention is to provide a pump capable of effectively maintaining low-noise operation even when the pressure of fluid being discharged from the pump has risen above or fallen below the rated pressure, without involving any adverse effect whatsoever.

A further object of the invention is to provide a pump which can be manufactured with ease and at low cost.

These and other objects, features and advantages of the invention will become more apparent from the following detailed description taken in conjunction with the accompanying drawings, in which.

Figure 1:
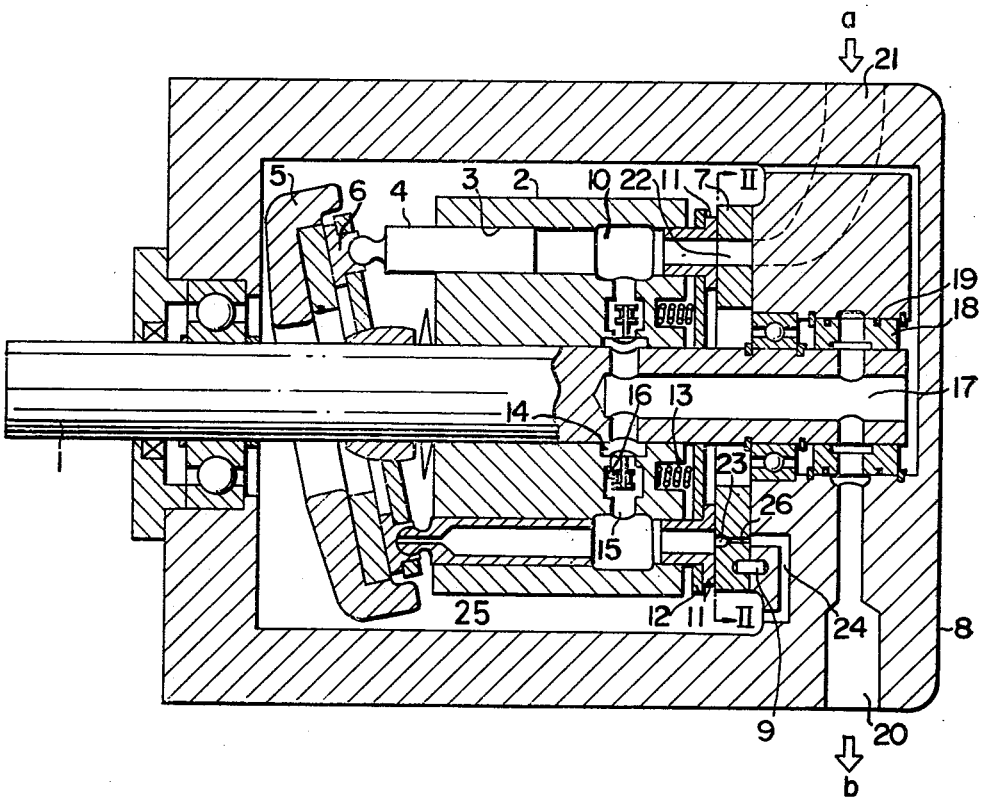
FIG. 1 is a vertical sectional view of a hydraulic pump embodying the invention.

Referring now to FIG. 1, there is shown a hydraulic pump as comprising a drive shaft 1, a cylinder block 2 fast on the shaft and having a plurality of cylinders 3 formed in parallel with the shaft and equidistantly spaced therearound, pistons 4 and slidably fitted in liquid tight engagement within the cylinders, a swash plate 5 operatively connected to one end of each of the pistons 4 via a retainer 6, a valve plate 7, and a casing 8 to the inner wall of which the valve plate is secured by pins 9. In the cylinder block 2 are also formed piston chambers 10 adjoining the cylinders, with slipper pads 11 partly inserted into the chambers and slidably biased by springs 13, via a retainer ring 12, into pressure contact with the valve plate 7. An annular discharge groove 14 is formed around the center bore of the cylinder block 2 receiving the drive shaft, and discharge ports 15 extend centripetally from the piston chambers 10 into communication with the annular discharge groove 14. Each of the discharge ports 15 contains a check valve 16. The drive shaft 1 is formed with a bore 17 for the discharging purpose, and has at the end a seal 18 with seal rings 19. A discharge outlet 20 formed in the casing 8 connects with the discharge bore 17. On the opposite side of the casing 8 is formed a suction inlet 21 in communication with an arcuate suction port 22. The valve plate 7 is formed with a groove 23 on the side in sliding contact with the slipper pads 11, the groove extending, as shown better in FIG. 2, arcuately from a point before the top dead center of the piston to a point slightly past the center. The groove 23 is communicated with the space 25 inside the casing through a relief passage 24 and an orifice 26.

With the construction described, the pump according to the invention operates in the following way. As the drive shaft 1 rotates, each piston 4 on the suction stroke moves downward (leftward as viewed in FIG. 1), drawing fluid from the suction inlet 21 as indicated by an arrow *a* into the piston chamber 10 via the arcuate suction port 22 in the valve plate 7 and the slipper pad 11. On the discharge stroke the piston 4 moves upward (rightward), increasing the pressure inside the piston chamber 10 above that inside the discharge groove 14. This will force the check valve 16 open and allow the fluid to be discharged from the piston chamber through the discharge port 15, groove 14, and bore 17 and finally through the outlet 20 to the outside as indicated by an arrow *b*. In this way any sudden backflow of fluid from the discharge groove 14 to the piston chamber 10 is avoided.

Figure 3:
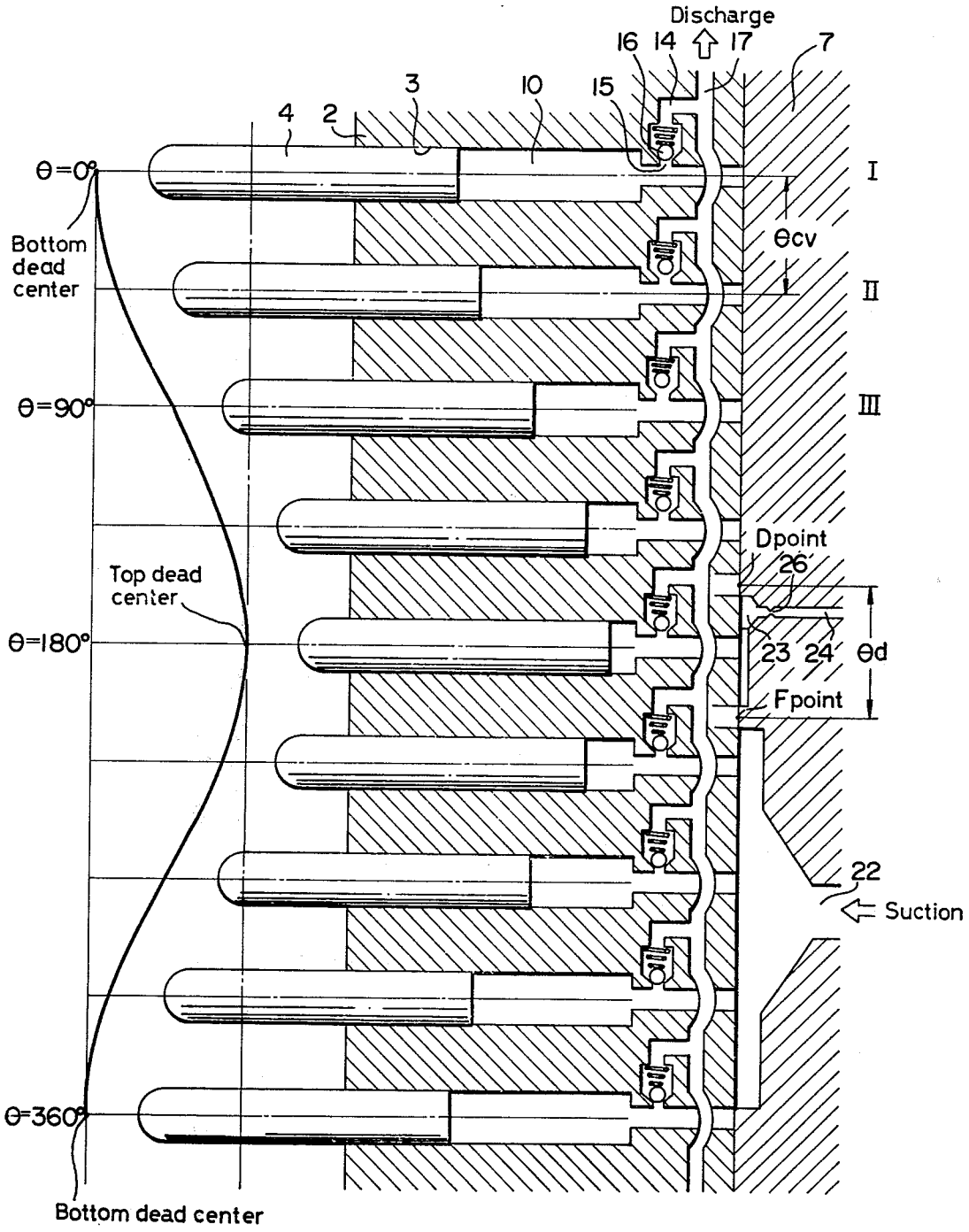
FIG. 3 is a development schematically illustrating the sequential operative relationship among the essential parts during one cycle of piston motion.

As shown in FIG. 3, each piston 4 in the first step I is at its bottom dead center. In the second step II the cylinder block 2 is slightly turned and the piston moved rightward, thus raising the pressure inside the piston chamber 10 above that in the discharge groove 14, with the consequence that the fluid begins to issue from the piston chamber 10 to the outside through the discharge port 15. In the third step III the piston is shown in a further advanced position.

In the step I the pump according to the invention functions in the same manner as a conventional one, but there are distinctions in the ensuing steps. In the conventional arrangement, as soon as the rotating cylinder block 2 has brought a piston chamber 10 into communication with the high-pressure port, the fluid will flow backward from the port to the chamber. This can be a cause of noisy operation. In the pump of the invention, by contrast, the check valve 16 installed in each discharge port 15 will remain closed, precluding the possibility of backflow, during the period in which the pressure inside the discharge bore 17 exceeds that inside the particular piston chamber 10.

As long as the check valve 16 is closed, the fluid in the piston chamber 10 will have no way out. With further rotation of the cylinder block 2, the piston 4 will move forward, compressing the fluid in the piston chamber 10. The fluid pressure will gradually increase until it exceeds the pressure inside the discharge groove 14 in the step II, where the cylinder block has rotated through an angle $\theta_{cr}$.

Figure 4:
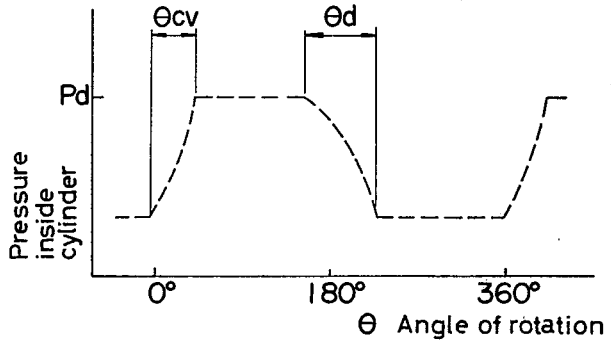
FIG. 4 is a graph showing changes of fluid pressure in the piston chamber when the discharge pressure of the pump is equal to the rated value.

At this point the check valve 16 is pushed open to release the fluid from the piston chamber 10. As a result, the pressure inside the piston chamber will increase gradually as shown in FIG. 4 without sharp pressure changes. When the cylinder 3 has turned to the point D in FIG. 3, communication is established between the piston chamber 10 and the groove 23. If the amount of fluid being discharged by the advancing piston 4 is exceeded at this time by the amount being released from the orifice 26 into the casing 25 via the relief pressure 24, the pressure inside the piston chamber 10 will drop below the discharge pressure and therefore the check valve 16 will immediately close and the piston chamber 10 pressure will begin decreasing.

However, during the section from the point D to the dead center, the piston 4 is moving forward and the pressure drop inside the piston chamber 10 is slowly effected to make up for the fluid lost due to the release from the orifice 26. Further, upon arrival of the cylinder 3 at the point F, the piston chamber 10 will communicate with the suction port 22 of the valve plate 7. The reduced-pressure section thus ranges from the point D to the point F, securing an angle $\theta_d$ (40° – 50°) for pressure reduction as in FIG. 3. This permits a moderate pressure drop, which in turn will contribute to noise control.

Figure 5:
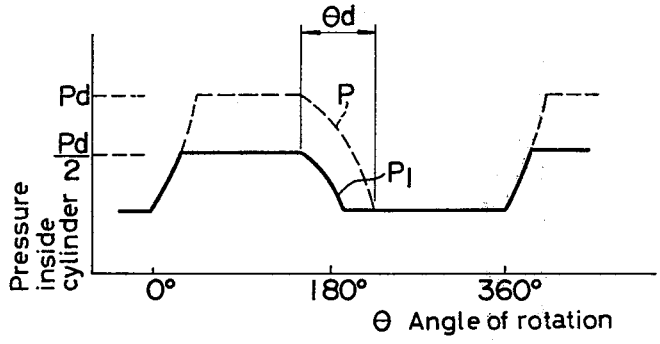
FIG. 5 is a graph corresponding to FIG. 4 but where the discharge pressure is below the rated value.
Figure 6:
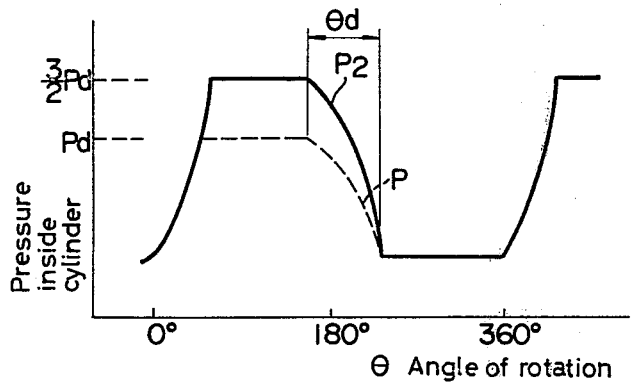
FIG. 6 is a graph corresponding to FIG. 4 but where the discharge pressure is above the rated value.

The hydraulic pump of the pressure reducing type according to the invention proves as effective with different discharge pressures. As indicated in FIG. 5, the pressure inside each piston chamber will draw the broken-line curve P when the discharge pressure of the pump is equal to a given rated pressure. When the pressure is lower than the rated level, the amount of fluid to be released from the orifice 26 will be smaller and the pressure-reducing effect thereby achieved will be limited, as represented by the full-line curve $P_1$. Conversely if the discharge pressure exceeds the rated one, the full-line curve $P_2$ of FIG. 6 will be obtained. In the manner described, such problems as the cavitation due to trapped expansion with a too low pump discharge pressure and the sharp pressure drop in the pressure chamber with a too high discharge pressure, will be largely overcome.

Figure 7:
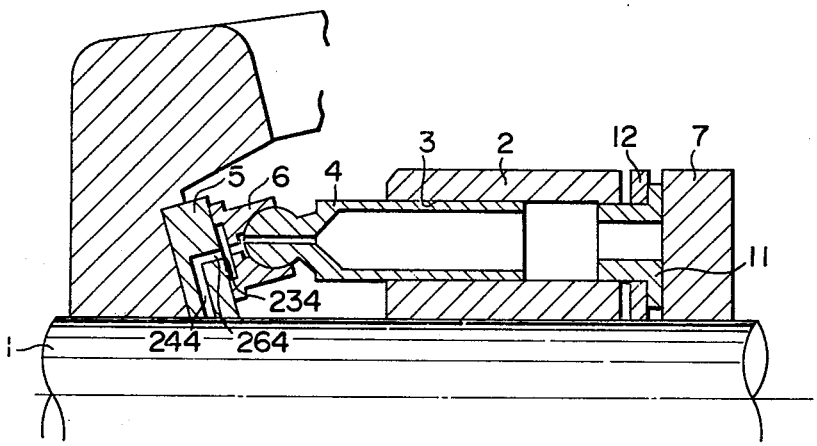
FIG. 7 is a fragmentary view, in vertical section, of another embodiment of the invention.

As an alternative, seen in FIG. 7, it is possible to form a passage through the spherical end of each piston 4 in communication with a passage also formed in the retainer 6 which opens against the sliding face of the swash plate 5, and also form a recess 234 communicated with a relief passage 244 having a pressure-reducing orifice 264. This modified arrangement will offer advantages similar to those of the first embodiment already described.

Figure 8:
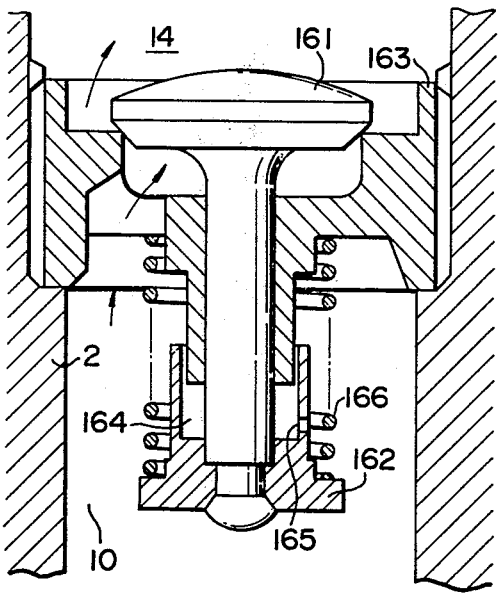
FIGS. 8 and 9 show, in section, two different forms of check valve for use with the pump in accordance with the invention.
Figure 9:
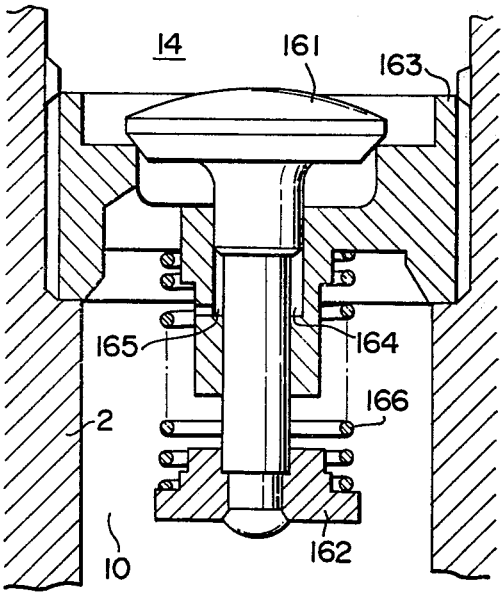

Since each check valve 16 is opened and closed tens of times a second, the opening of the valve tends to cause irregular vibration of the poppet with abnormal sound, and hence noisy operation and an adverse effect on the valve life. Steps to minimize these possibilities are taken in accordance with the present invention. As FIG. 8 shows, the spring bearing 162 supporting a spring 166 on the poppet 161 of each check valve 16 is formed with an oil sump 164 or, alternatively, as in FIG. 9, the sump 164 may be formed in the valve seat 163 instead. Each sump has an orifice 165. In either arrangement the poppet 161 which would otherwise undergo high frequency vibration will be kept from such motion because the vibration is mostly absorbed by the compression of the fluid in the sump 164. Thus, if the orifice 165 is of a suitably chosen diameter, the abnormal vibration will be prevented and the noise reduced without affecting the normal opening and closing motion of the valve.

Figure 11:
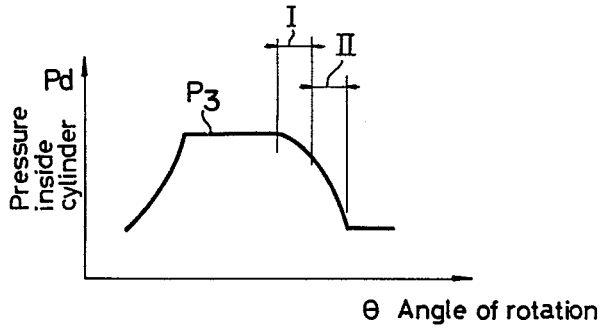
FIG. 11 is a graph corresponding to FIG. 4 but pertaining to the embodiment shown in FIG. 10.
Figure 10:
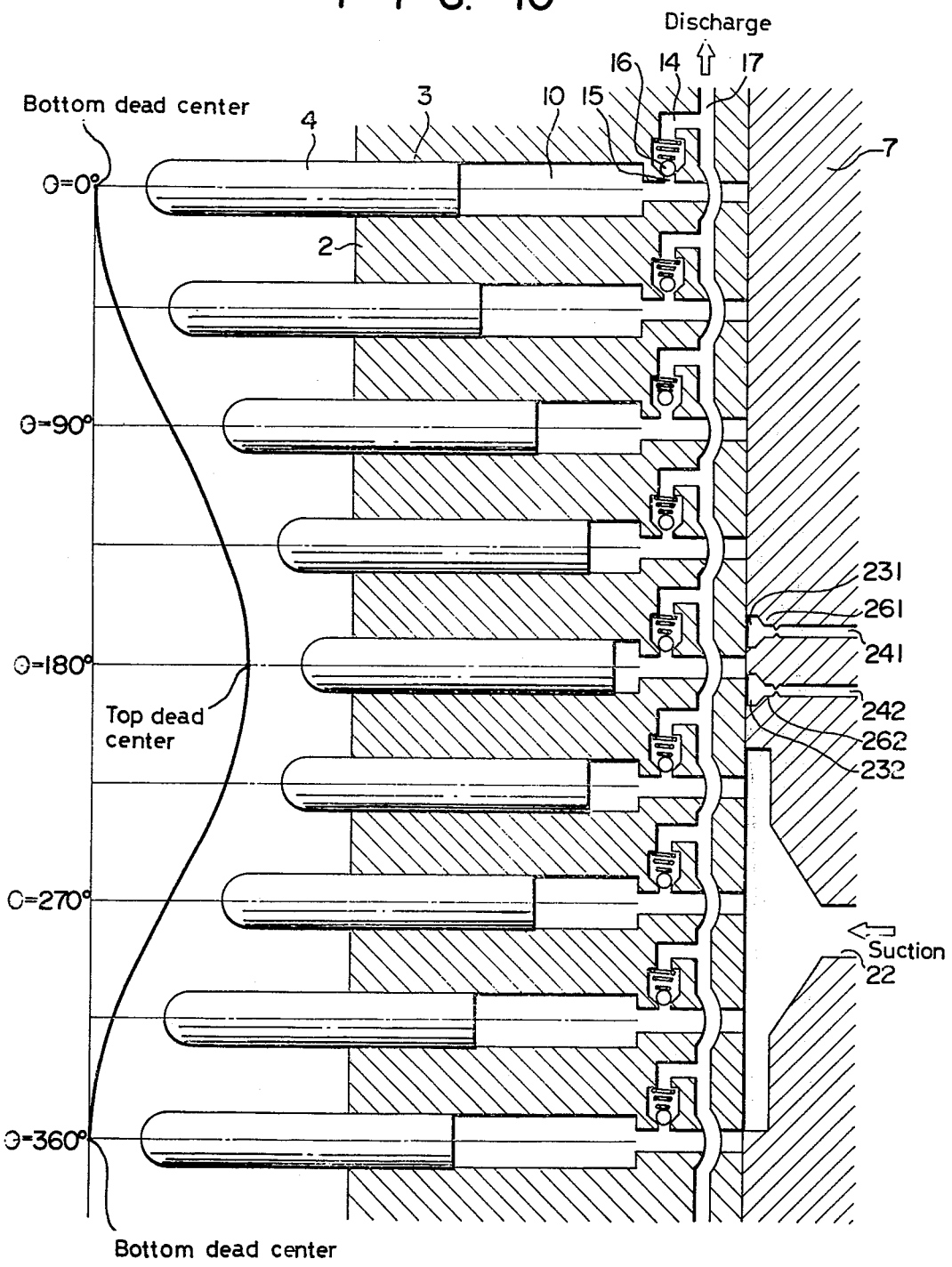
FIG. 10 is a development similar to FIG. 3 but pertaining to another embodiment of the invention.

In still another embodiment shown in FIG. 10, two grooves 231, 232 are formed on the sliding face of the valve plate 7 and are communicated with the spaces 25 inside the casing via orifices 261, 262 and relief passages 241, 242, respectively. The pressure in each piston chamber 10 will then undergo changes as represented by the curve $P_3$ in FIG. 11. The orifices 261 and 262 contribute to the pressure reduction in the sections I and II, respectively, of the curve $P_3$ and thereby render it possible to adjust the pressure changes to a desired curve.

Figure 2:
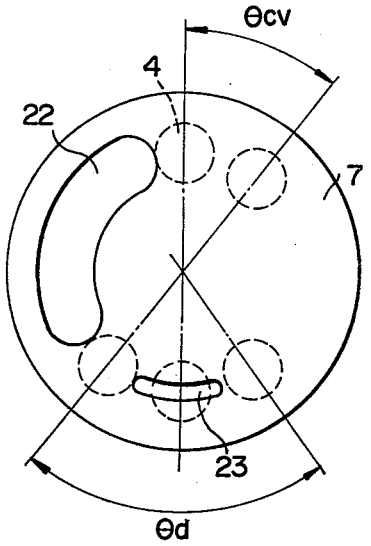
FIG. 2 is a front view of the valve plate as taken along the line II—II of FIG. 1.

While the present invention has been specifically described in conjunction with the accompanying drawings, particularly FIGS. 1 and 2 showing a preferred embodiment thereof, it is to be noted that the essence of the invention resides in an axial piston type hydraulic pump comprising check valves each of which is adapted to open upon increase of the pressure in the associated cylinder to a level above the discharge pressure of the pump and thereby permit the discharge of fluid from the cylinder, passage means for communicating each cylinder to the low-pressure system including a pump suction pipe or drain tank during the period in which the piston on the compression stroke moves from a point short of the top dead center to a point past the center and where the cylinder communicates with the suction port, and pressure-reducing means disposed in the passage means. It should be understood, therefore, that the invention is not limited to the specific embodiments described but is, of course, applicable as well to many other varieties of axial piston type hydraulic pumps. Possible applications include, for example, the pump in which the cylinders are kept stationary and a swash plate set on the drive shaft rotates instead (as taught by Japanese Patent Publication No. 17940/72) and those in which the drive shaft is held across the axis of rotation of the cylinder block and a wobble plate on the shaft is drivingly coupled to the individual pistons (U.S. Pat. No. 3,556,683 and British Patent 558,477).

The pump according to the present invention has the following advantages. The check valve installed in the discharge port of each cylinder prevents backflow of fluid from the discharge side of the pump to the piston chamber and thereby controls the vibrating force which can be a cause of noisy operation with sharp changes of pressure in the individual piston chambers. Since each check valve is designed to remain closed unless the fluid pressure inside the associated piston chamber is equal to or higher than the fluid pressure at the discharge, compression of the fluid trapped in the piston chamber is made possible until the pressure in the chamber reaches the same level as the discharge pressure. This moderates the pressure changes in the piston chambers and remarkably improves the mechanical vibration. In addition, there is little chance of noise development due to cavitation, even if air entrainment is caused by cavitation in the piston chamber as a result of trapped expansion in the starting period of the suction stroke. This is because, in accordance with the present invention, trapped compression is effected at the time of discharge until the pressure in the piston chamber becomes equal to the pressure in the discharge groove. Consequently, a sufficiently wide section can be provided for the trapped expansion at the top dead center.

Also, according to the present invention, the drive shaft has a bore formed as an axial passage in communication with the discharge outlet of the pump, and therefore the shaft need only to be sealed therearound, thus simplifying the sealing problem.

Because the check valves close in the directions where centrifugal force is exerted, designing the springs for the valves is made easy and even springless check valves may be contemplated to advantage in both cost and life.

At the start of pump operation, air in the piston chambers is separated from the hydraulic fluid by the difference in specific gravity and is collected from the chambers by the centrifugal force toward the center of the cylinder block 2. The air discharge is facilitated by the discharge ports 15 centripetally extended in the cylinder block 2, and this also proves helpful in combatting the operation noise.

The check valve mechanism is press fitted or screwed into position from the center bore of the cylinder block that subsequently receives the drive shaft. Naturally both the discharge pressure and centrifugal force act in the directions where the check valves are kept from loosening. Hence the valves are secured in place with increased reliability.

In addition, the check valves 16 installed within the cylinder block produce little external sound during valve operation. This is another beneficial factor for noise control.

Since the discharge ports 15 are centripetally extended from the cylinders 3 and the cylinders themselves extend straight through the cylinder block 2 in parallel to the axis of the drive shaft, the cylinder block is not subjected to any thrust on increase of pressure in any piston chamber. The construction enables the drive shaft to run very smoothly and thereby eliminates the usual source of vibration.

The pressure-reducing orifice 23 formed in either the valve plate or swash plate, in the area ahead of the point where each piston reaches its top dead center, can release fluid from the piston chamber and reduce the pressure before the advancing piston reaches the top dead center. As a consequence, a gradual pressure drop is made possible over an effective pressure-reducing section through an angle of more than 40 deg. This in turn precludes cavitation during low-pressure operation and reduces the valve noise to a minimum.

Further, the check valves are formed with an oil sump and an orifice to function like oil dampers. In this manner irregular vibration of the check valves is prevented for the purposes of low-noise operation and long life of the hydraulic pump.

What is claimed is:

1. A hydraulic axial piston pump comprising means defining a plurality of cylinders each having therein a piston reciprocably movable between a top dead center position and a bottom dead center position to effect a compression stroke and a suction stroke, said piston completing its compression stroke at said top dead center position, discharge means for said pump for discharging fluid from said cylinders during the compression stroke of their associated pistons, check valve means within said discharge means, said check valve means comprising a check valve for each of said cylinders adapted to open and allow the associated cylinder to discharge fluid when the pressure within the cylinder has been raised above the discharge pressure of said pump by an associated piston on its compression stroke, passage means for communicating each of said cylinders with a low pressure system during a period in which the piston associated with said cylinder moves from a point preceding its top dead center position to a point past its top dead center position where said cylinder communicates with a suction port of said pump, and pressure reducing means disposed in said passage means.

2. A hydraulic pump according to claim 1 wherein each check valve includes a poppet formed with a fluid sump and an orifice communicating the sump with the outside.

3. A hydraulic pump according to claim 1 wherein each of the check valves comprises a valve seat, a poppet resting on the seat, a spring bearing on the poppet, and a spring loaded between the spring bearing and the valve seat, the portion of the spring bearing or the valve seat surrounding the poppet being formed with an oil sump and an orifice communicating the sump with the outside.

4. A hydraulic pump according to claim 1 wherein said cylinders are formed in a cylinder block arranged in a mutually spaced relationship around and in parallel to a central axis of said block, said pistons being operatively connected at the outer ends thereof with a swash plate.

5. A hydraulic pump according to claim 4 wherein said cylinder block is fixedly mounted upon a drive shaft and wherein said swash plate is nonrotative.

6. A hydraulic pump according to claim 5 wherein said cylinder block includes an end face extending at right angles to the axis of rotation of said cylinder block, ports in communication with said cylinders, a valve plate in sliding engagement on one side thereof with said end face of the cylinder block, said valve plate being formed with an arcuate port in communication with the suction inlet of the pump and also with a passage forming part of said passage means for connecting each of said ports with said low pressure system.

7. A hydraulic pump according to claim 5 wherein said drive shaft is formed with an axial discharge passage formed as part of said discharge means of the pump and also connected to piston chambers through centripetally extending fluid passages, each of said passages containing a check valve.

8. In a variable-delivery hydraulic pump of the type having a valve plate and a cylinder block defining piston chambers therein and adapted to rotate in sliding contact with said valve plate, the improvement wherein said valve plate is formed with an arcuate suction port, said cylinder block having a plurality of pads arranged between said cylinders and said valve plate, each of said pads being directly pressed against the valve plate by pressure within an associated piston chamber in such a manner that the pad on the suction stroke establishes communication between the piston chamber and the arcuate suction port, said cylinder block having discharge ports extending centripetally from the cylinders and opening into a centrally located discharge passage, and check valves installed in the discharge ports, each of the valves being adapted to open when the pressure inside the associated piston chamber exceeds the discharge pressure on the discharge stroke, said discharge ports from the piston chamber and said discharge outlet being communicated to a low pressure system of said pump by discharge passage means having pressure reducing orifice means therein provided at a point at least short of the point where an advancing piston reaches its top dead center position.

9. A hydraulic pump according to claim 8 wherein said discharge passage means including said pressure reducing orifice means is formed to extend through said valve plate.

10. A hydraulic pump according to claim 9 wherein said discharge passage means comprise a pair of separate discharge passages each including a pressure reducing orifice of said pressure reducing orifice means.

11. A hydraulic pump according to claim 8 wherein said discharge passage means are formed to extend through said swash plate in sliding contact with one of the ends of said pistons.

12. A hydraulic pump according to claim 5 wherein each of said pistons is formed with passage which extends therethrough and which opens at a sliding face of said swash plate, with a corresponding passage being formed in the swash plate to communicate said passage with the low-pressure system.

13. A hydraulic pump according to claim 1 wherein said passage means leading to said low-pressure system is divided into a plurality of passages with each of the resulting passages being provided with pressure reducing means.

* * * * *

UNITED STATES PATENT OFFICE

CERTIFICATE OF CORRECTION

Patent No. 4007663 Dated February 15, 1977

Inventor(s) Kuniyasu Nagatomo et al

It is certified that error appears in the above-identified patent and that said Letters Patent are hereby corrected as shown below:

In the heading of the Patent, [73] should read as follows:

--[73] Assignee: Mitsubishi Jukogyo Kabushiki Kaisha, Tokyo, Japan--.

Signed and Sealed this

Third Day of May 1977

[SEAL]

*Attest:*

RUTH C. MASON
*Attesting Officer*

C. MARSHALL DANN
*Commissioner of Patents and Trademarks*